United States Patent [19]

Yu

[11] 3,973,384

[45] Aug. 10, 1976

[54] FRICTION AGGREGATE

[75] Inventor: Jing-peir Yu, Pensacola, Fla.

[73] Assignee: Monsanto Company, St. Louis, Mo.

[22] Filed: Dec. 30, 1974

[21] Appl. No.: 537,167

[52] U.S. Cl. ..... 57/77.4

[51] Int. Cl.[2] ..... D02G 1/04

[58] Field of Search ..... 57/7.3–77.45

[56] References Cited

UNITED STATES PATENTS

| | | | |
|---|---|---|---|
| 3,287,890 | 11/1966 | McIntosh et al. | 57/77.4 |
| 3,762,149 | 10/1973 | Raschle | 57/77.4 |
| 3,813,868 | 6/1974 | Lorenz | 57/77.4 |
| 3,820,317 | 6/1974 | Raschle | 57/77.4 |
| 3,872,661 | 3/1975 | Eaves | 57/77.4 |
| 3,885,378 | 5/1975 | Schuster | 57/77.4 X |
| 3,901,011 | 8/1975 | Schuster | 57/77.4 |

*Primary Examiner*—Donald E. Watkins
*Attorney, Agent, or Firm*—Kelly O. Corley

[57] ABSTRACT

In a false twist friction aggregate, the shafts are not all driven at the same speed. This produces higher twist levels, lower inlet tensions, and higher outlet tensions as compared to conventional aggregates.

5 Claims, 3 Drawing Figures

FRICTION AGGREGATE

The invention relates to apparatus for producing a false twist in a moving strand or yarn. More particularly, the invention relates to such apparatus wherein the yarn tensions and the twist levels can be preselected with a useful degree of independence from one another.

Various references disclose the type of false twist apparatus wherein at least three substantially parallel shafts rotating in the same direction are grouped about the yarn path, each shaft supporting and driving at least one and preferably a plurality of friction discs which are interleaved between the discs of the other shafts. The disc diameters are large enough with respect to the spacing between the shafts that a yarn passing through the device from inlet to outlet will follow a distinctly tortuous path as it contacts and is deflected by the successive discs. Such false twisting devices are disclosed, for example, in FIGS. 2–8 of U.S. Pat. No. 3,813,868 to Lorenz, the disclosure of which is incorporated herein by reference, and are referred to herein as "friction aggregates". Other patents disclosing friction aggregates include U.S. Pat Nos. 2,939,269; 3,827,228; and 2,923,121, although the friction disc diameters in this latter patent are not sufficiently large with respect to the spacing between its shafts to deflect the yarn into an adequately tortuous path for good twist development. The discs are preferably interleaved in a sequence such that a yarn passing through the friction aggregate from inlet to outlet will sequentially contact the successive discs at points lying on a helix of the same hand as the direction of rotation of the discs, as disclosed in U.S. Pat. Nos. 3,813,868 and 3,827,228.

Known friction aggregates, such as those disclosed in the above-noted patents (with the exception of the Lorenz patent), do not permit independent selection of the twist level and yarn tensions. When the rotational speed of the discs is selected to provide a desired high level of false twist, the tension in the yarn entering the inlet end of the friction aggregate is frequently undesirably high, while the tension in the yarn leaving the outlet end is frequently undesirably low. Either or both of these tension conditions can cause difficulties in the process or defects in the product produced.

The Lorenz patent discloses that the spacing between the shafts can be adjusted, thus exerting some control over tensions and twist levels. Such adjustment does not, per se, permit independent selection of tensions and twist level. The Lorenz patent does disclose an approach to solving the problem of independent selection, by driving one or more supplementary friction discs at different angular velocities than those of the remainder of the discs. This approach has the disadvantage of requiring a more complex and expensive mechanism than the more simple friction aggregates.

According to the invention, the above difficulties and disadvantages are overcome or substantially reduced by driving one or more of the shafts at different speeds, as more fully disclosed below.

The invention is illustrated in the accompanying drawings, wherein.

Figure 1:
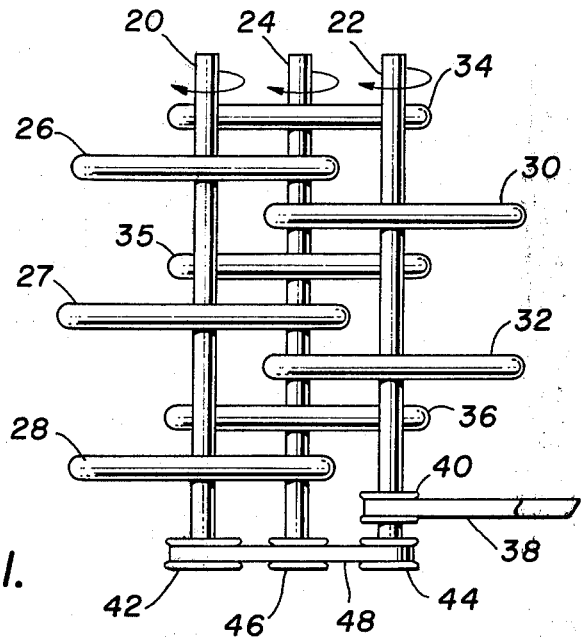
FIG. 1 is a front elevation view of an exemplary embodiment of the invention.

The FIG. 1 aggregate comprises substantially parallel shafts 20, 22 and 24 grouped about a yarn path and supported for rotation by conventional bearings and frame members (not illustrated). Discs 26, 27 and 28 are mounted on and driven by shaft 20. In like manner, discs 30 and 32 are mounted on and driven by shaft 22, while discs 34, 35 and 36 are mounted on and driven by shaft 24. Except for inlet disc 34 and outlet disc 28, each of the remaining discs on any given shaft is interleaved between discs mounted on the other two shafts. The disc diameters are sufficiently large with respect to the spacing between the shafts that the yarn passes through the aggregate in a tortuous path from inlet end to outlet end, contacting and being deflected successively by discs 34, 26, 30, 35, 27, 32, 36 and 28. Belt 38 drives shaft 22 by way of pulley 40 mounted on shaft 22. Further pulleys 42, 44 and 46 mounted on shafts 20, 22 and 24 respectively, together with belt 48, provide for driving shafts 20 and 24 from shaft 22.

According to the invention, at least one of the shafts is driven at a lower angular velocity than at least one other of the shafts. This is accomplished in the illustrated embodiment by selecting pulley 42 to have a larger diameter than those of pulleys 44 and 46.

Figure 2:
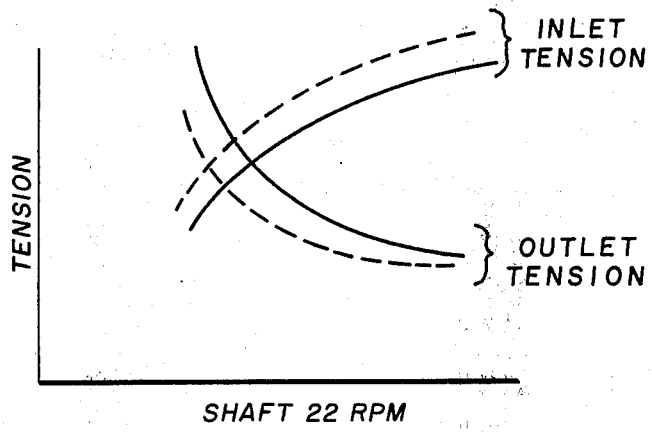
FIG. 2 is a graph comparing yarn tensions according to the invention with the prior art.
Figure 3:
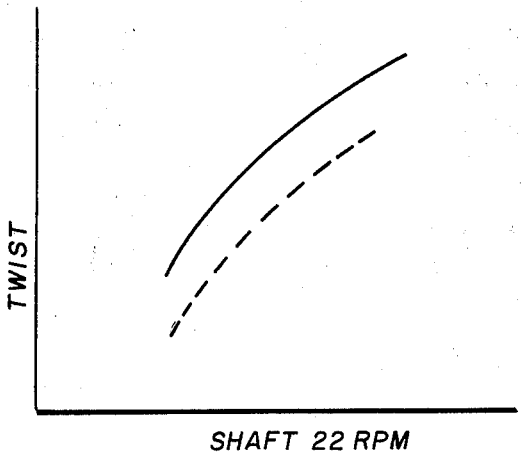
FIG. 3 is a graph comparing twist levels according to the invention with the prior art.

If disc 26 is not increased in diameter so as to provide a compensating increase in peripheral velocity, this will result in lower inlet tension above the aggregate, higher outlet tension below the aggregate, and higher false twist level above the aggregate, as compared to the known prior art wherein all discs of an aggregate rotate at the same angular velocity. These desirable results are illustrated qualitatively in FIGS. 2 and 3, wherein tensions and twist levels according to the invention, using the same diameters for all discs, are shown in solid lines as compared to the known prior art (except the Lorenz patent) shown in dotted lines. The Lorenz devices are capable of producing the same results as the present invention, but do so by the use of more complex and expensive mechanisms.

In a specific exemplary embodiment, shafts 20, 22 and 24 are parallel and spaced 38 millimeters from each other. Inlet guide disc 34 and outlet guide disc 28 are made from steel, which has a relatively low coefficient of friction with the yarn. They thus are not believed to greatly contribute to the twisting effect, but serve instead largely to stabilize the yarn path and guide the yarn to the inlet friction disc 26 and away from the outlet friction disc 36. These latter two discs, together with the remaining friction discs 30, 35, 27 and 32 are formed from polyurethane. If still higher outlet tension is desired, disc 28 may be formed from polyurethane, thus becoming the outlet friction disc rather than a guide disc. All discs have diameters of 50 millimeters. Each disc is 6.0 millimeters thick, and the rims or edges of the discs are crowned or rounded with a radius of curvature of 3.5 millimeters. The axial spacing between adjacent interleaved discs, that is, between discs 26 and 30, between discs 30 and 35, etc., is 0.5 millimeters. Pulleys 44 and 46 have the same given diameter, while pulley 42 has a diameter 10% larger than the given diameter.

Not only could comparable twist levels be produced at lower RPM using the present aggregate, but the quality of the textured yarn is superior to that produced with a conventional aggregate. Yarn which has been textured by the false-twist heat-set method frequently has local defects referred to as "tight spots". These are local sections of yarn containing twist, which prevents the desired bulking or blooming of the yarn. When the yarn is converted into fabric, the tight spots cause the appearance of voids or pin-holes in the fabric. The problem of tight spots is more severe with friction aggregates than with the conventional spindlettes.

Polyethylene terephthalate yarn having 34 filaments and 150 denier, false-twisted and heat-set with 2560 turns per meter false-twist by a conventional aggregate (approximately 5500 RPM disc speed) contains numerous tight spots, and is not of commercial quality, while yarn produced at the same twist level by the exemplary aggregate (approximately 4500 RPM at shaft 22) contains very few tight spots, and is considered to be of excellent commercial quality.

In some cases it may be desirable to provide disc 27 with a larger diameter so that its peripheral velocity more nearly approximates or substantially equals the peripheral velocities of discs 32 and 35 between which it is interleaved. Thus in the above specific exemplary embodiment, disc 27 may have a diameter of 55 millimeters, and thus would have the same peripheral velocity as discs 32 and 35. This permits further selection of the yarn tensions and their distribution. Generally speaking, however, satisfactory results can be obtained by making all discs identical, thus simplifying manufacture and stocking of the discs as well as eliminating the chances for error in assembling the discs on the respective shafts.

I claim:

1. In a friction aggregate wherein at least three substantially parallel shafts are grouped around a yarn path extending from the inlet end to the outlet end of said aggregate, each said shaft supporting and driving at least one friction disc interleaved between discs on each of said other shafts, the disc diameters being large enough with respect to the spacing between said shafts that a yarn passing through said aggregate from inlet to outlet will follow a tortuous path as said yarn contacts and is deflected by successive discs, the improvement wherein at least a first of said shafts is driven at a lower angular velocity than at least one other of said shafts.

2. The aggregate defined in claim 1, wherein said first of said shafts supports and drives the inlet friction disc of said aggregate.

3. The aggregate defined in claim 1, wherein said first of said shafts supports and drives the outlet friction disc of said aggregate.

4. The aggregate defined in claim 2, wherein said at least one disc on said first of said shafts has a larger diameter than said inlet friction disc.

5. The aggregate defined in claim 4, wherein said at least one disc on said first of said shafts has substantially the same peripheral velocity as the adjacent discs between which it is interleaved.

* * * * *